US012404641B2

(12) United States Patent
Annan

(10) Patent No.: US 12,404,641 B2
(45) Date of Patent: Sep. 2, 2025

(54) ARMOURY ELEMENT FOR THE PROTECTION OF A STRUCTURAL MATERIAL AND/OR LOAD-CARRYING ELEMENT

(71) Applicant: VSL International AG, Bern (CH)

(72) Inventor: Rachid Annan, Rapperswil (BE)

(73) Assignee: VSL International AG, Bern (CH)

( * ) Notice: Subject to any disclaimer, the term of this patent is extended or adjusted under 35 U.S.C. 154(b) by 874 days.

(21) Appl. No.: 17/615,274

(22) PCT Filed: Jun. 11, 2019

(86) PCT No.: PCT/EP2019/065228

§ 371 (c)(1),
(2) Date: Nov. 30, 2021

(87) PCT Pub. No.: WO2020/249193

PCT Pub. Date: Dec. 17, 2020

(65) Prior Publication Data

US 2022/0236036 A1 Jul. 28, 2022

(51) Int. Cl.

| | |
|---|---|
| ***E01D 19/16*** | (2006.01) |
| ***E04H 12/20*** | (2006.01) |
| *E04H 9/04* | (2006.01) |

(52) U.S. Cl.
CPC ..... *E01D 19/16* (2013.01); *E04H 12/20* (2013.01); *E04H 9/04* (2013.01)

(58) Field of Classification Search
CPC ..... E01D 11/00; E01D 11/02; E01D 11/04; E04H 9/06
See application file for complete search history.

(56) References Cited

U.S. PATENT DOCUMENTS 4,848,052 A * 7/1989 Nutzel ..... E01D 19/16 52/223.13
6,292,967 B1 * 9/2001 Tabatabai ..... F16F 7/104 188/380

(Continued)

FOREIGN PATENT DOCUMENTS

CN 108755411 11/2018
CN 109972516 A * 7/2019 ..... D07B 1/162

(Continued)

OTHER PUBLICATIONS

International Search Report and Written Opinion in PCT/EP2019/065228 mailed on Jan. 22, 2020, 7 pages.

*Primary Examiner* — Gary S Hartmann
(74) *Attorney, Agent, or Firm* — Tucker Ellis LLP

(57) ABSTRACT

An armoury assembly is provided for the protection of a structural material and/or load-carrying element having a longitudinal axis. The armoury assembly is provided longitudinally surrounding the structural material and/or load-carrying element to be protected. The armoury assembly comprises at least two different layers, one being an energy-absorption matrix, the other layer being made of a metal, an alloy or a fibre reinforced polymer having a thickness less than the energy-absorption matrix. Two or more longitudinal channels are provided to the armoury assembly, wherein the channels are substantially parallel to the longitudinal axis of the structural material and/or the load-carrying element.

18 Claims, 4 Drawing Sheets

(56) References Cited

U.S. PATENT DOCUMENTS

| | | | | |
|---|---|---|---|---|
| 8,795,832 | B2 * | 8/2014 | Fyfe | D07B 5/00 427/230 |
| 11,473,252 | B2 * | 10/2022 | Brand | E01D 19/16 |
| 2008/0121151 | A1 * | 5/2008 | Hallissy | F41H 5/0442 109/38 |
| 2020/0263355 | A1 * | 8/2020 | Erdogan | E01D 19/00 |
| 2020/0332464 | A1 * | 10/2020 | Dugain | E01D 19/16 |

FOREIGN PATENT DOCUMENTS

| | | | | |
|---|---|---|---|---|
| EP | 2204823 | | 7/2010 | |
| FR | 2794477 | | 12/2000 | |
| FR | 2897623 | A1 * | 8/2007 | E01D 19/14 |
| WO | WO-2018196966 | A1 * | 11/2018 | D07B 1/147 |

* cited by examiner

ARMOURY ELEMENT FOR THE PROTECTION OF A STRUCTURAL MATERIAL AND/OR LOAD-CARRYING ELEMENT

TECHNICAL FIELD OF THE INVENTION

The present invention relates to the technical field of cables, in particular to stay cables, but it is also equally applicable to other technical fields relating to architectures including constructions and buildings. Constructions such as masts, towers, bridges, footbridges and roofs for stadium, where their essential and functional components (columns, beams or rods and the like) are to be protected from external and sudden threats, for instance from fire outbreak, targeted cutting by grinder or torch, sudden explosion or targeted blast.

BACKGROUND OF THE INVENTION

In recent time, an increasing number of fire outbreaks and terrorist attacks have shown that the effects of fire and blast loads on constructions and buildings are serious matters that should be taken into consideration, whether in the initial design process, during the construction process or after the completion of the construction.

Although these kinds of attacks are man-made disasters and are usually exceptional cases, its potential loss from fire or blast (blast load) are in fact needs to be carefully calculated just like other risks such as earthquake and wind loads.

For these reasons, damage to the assets, loss of life and social panic are factors that have to be minimized if those threats cannot be stopped.

Patent document GB 686804A relates to a protection armour for electric cables. It discloses that the electrical cable comprises an external protective armour constituted of metallic braid. The component elements are entirely and individually coated with a tough, flexible and dielectric material, wherein the material is a plastic capable of resisting corrosion, abrasion and not inflammable.

Another patent document U.S. Pat. No. 2,909,336 relates to an armoured cable, for instance an armoured subaquatic cable, in which the armour is formed by a plurality of wires wound helically around a core of the cable. The armoured cable comprises a bunch of metal filaments formed of copper, aluminium or their alloys, being wrapped or encased in layers of fabric, rubber, impregnated paper, bitumen impregnated jute and sheath to form a protective shield over said cable.

Although these cables are being provided with an armour protection, they are not ideal for the protection for the purpose of the present case where the elements to be protected should be safe from fire outbreaks and/or blast. Although designing the structures to be fully fire- and blast resistant is not a realistic and an economical option, the need for such an armoury element for precautionary purpose remains high.

SUMMARY OF THE INVENTION

The inventors of the present invention have found out effective remedies for the above-discussed problems with the current engineering and architecture knowledge such that the new and existing constructions and buildings can be equipped with the protective assemblies and elements according to the present invention to mitigate the effects of external threats including fire outbreaks and sudden blast.

In a first aspect, present invention relates to an armoury assembly for the protection of a structural material and/or load-carrying element having a longitudinal axis, wherein the armoury assembly is provided longitudinally surrounding the structural material and/or load-carrying element to be protected, wherein the armoury assembly comprises at least two different layers, one being an energy-absorption matrix, preferably confined or supported within and by the other, being made of a metal, an alloy or a fibre reinforced polymer having a thickness less than the energy-absorption matrix, wherein two or more longitudinal channels are being provided to the armoury assembly, wherein the channels are substantially parallel to the longitudinal axis of the structural material and/or the load-carrying element.

In a second aspect, present invention relates to a stay cable pre-fitted or retro-fitted with an armoury assembly of the present invention.

In a third aspect, present invention relates to a structural material of a construction or a building, wherein its component such as column, rod or beam is pre-fitted or retro-fitted with an armoury assembly of the present invention.

In one embodiment of the present invention, the armoury assembly comprises two or more channels, wherein at least one of the channel has a geometry which permits threading of a single wire or strand element thereto. This has the advantageous of exerting compressing forces (e.g. longitudinally, radially and etc.) to the armoury assembly 100.

In yet another embodiment of the present invention, the energy-absorption matrix comprises a solid filler such as concrete, ashcrete, polymer-concrete or timbercrete having a compressive strength of at least about 20 MPa and/or at most about 300 MPa, preferably at most about 120 MPa. Concrete has the advantage of easy availability for large-scale production. Ashcrete is a concrete alternative that uses fly ash instead of traditional cement. By using fly ash, a by-product of burning coal, 97 percent of traditional components in concrete can be replaced with recycled material, hence it is more environmentally. Polymer-concrete is concrete matrix reinforced by polymeric fibres which present higher ductility and fire resistance, permitting higher energy absorption and better protective capabilities. Timbercrete is a building material made of sawdust and concrete mixed together. Since it is lighter than concrete, it reduces transportation emissions, and the sawdust both reuses a waste product and replaces some of the energy-intensive components of traditional concrete. Due to its light-weight, Timbercrete could be an option for the armoury assembly for use in stay cable for instance.

In a further embodiment, at least some or most of the channels are being provided to the energy absorption matrix to accommodate one or more wire or strand elements thereto, wherein the wire or strand element can be arranged in such a way to exert compressing force radially along the longitudinal axis. This allows the armoury assembly to be strengthened by the synergistic effect from the energy absorption matrix and the wire/strand elements.

In one preferred embodiment, pipe element being provided to the longitudinal channel for receiving wire or strand element accommodated thereto, wherein the wire or strand element extends axially or a helical along the longitudinal axis, for instance in a single-, double- or multiple-helical manner e.g. laying in both left handed and right handed direction.

In another preferred embodiment, the layer made of metal, alloy or fibre reinforced polymer comprises a plurality of patch-like elements that are being assembled, connected and tightened to each other e.g. by use of strand or wires such as to permit later retrofit of critical member by such protection, preferably arranged in such a way to exert a compression force towards the central axis of the structural material and/or load-carrying element.

In yet another embodiment, the armoury assembly comprises an outer layer and an inner layer, wherein the layers being made of a metal, an alloy, or fibre reinforced polymer. High temperature resistance metal or alloy can be used to for such layers. Alternatively, fibre reinforced polymers can be selected due to its light weight property. In a further embodiment, the inner layer can be made of fibre reinforced polymer and the outer layer can be made of metal or alloy.

According to one specific embodiment, the pipe element comprises the inner layer or can be considered to be identical as the inner layer. In this embodiment, the inner layer is in form of a pipe such that it is capable of receiving structural material and/or load-carrying element to be protected.

According to another particular embodiment, the inner layer is provided to surround longitudinally at least some of the load-carrying elements such as strand bundles of tensile elements, wherein the each inner layer surrounding longitudinally the load-carrying elements to be protected preferably has the same thickness as the outer layer. This embodiment has the advantage that some of the load-carrying elements can be served as a sacrificial component (if no inner wall or layer surrounding them) while the overall structure integrity of the elements to be protected remains intact.

In one particularly preferred embodiment, the energy absorption matrix is sandwiched between the outer layer and the inner layer. This configuration gives an optimum protection for the structural material and/or load-carrying element to be protected.

In yet a preferred embodiment, a plurality of the longitudinal channels having approximately about the same diameter are provided to the armoury assembly for accommodating wire or strand element and/or load-carrying element.

In a further embodiment, the channels being provided to the armoury assembly are arranged randomly or distance approximately equally from each other. Such arrangement allows an optimal protection from fire and blast threats. For instance, the distance between each longitudinal channel is preferably between 0 cm and 50 cm, preferably between 0.2 cm and 25.0 cm, or preferably between 0.2 cm and 2.0 cm.

In one specific embodiment, the outer layer being made of a material having a yield strength of at most about 2000 MPa and/or at least about 200 MPa, and the inner layer is made of a material having a yield strength of at most 2000 MPa and/or at least about 200 MPa.

DETAIL DESCRIPTION OF THE INVENTION

Several preferred embodiments of the present invention will now be described in detail with reference to the accompanying drawings. In the following description, a detailed description of known functions and configurations incorporated herein has been omitted for conciseness. To this end, it is pointed out that different features from different embodiments can be selected to be combined together within capability of a skilled person in the art.

Figure 1A:
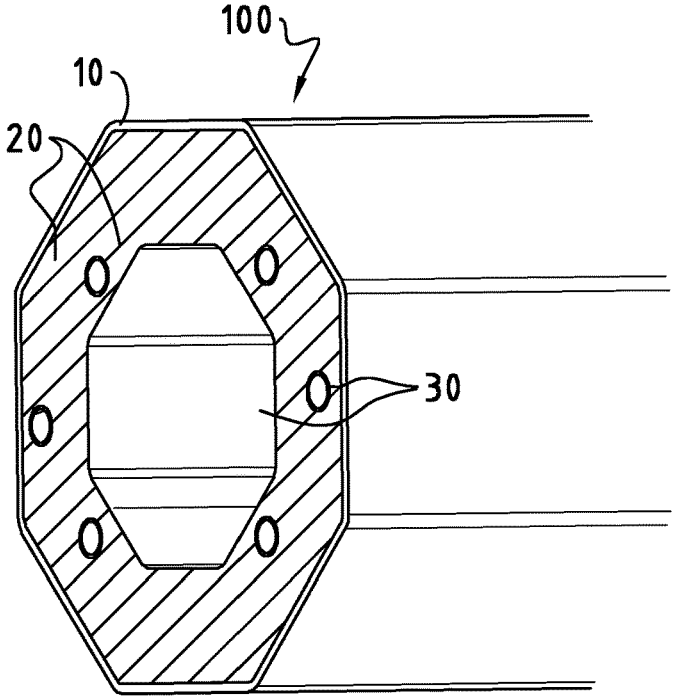
FIG. 1*a* is a perspective view of the armoury assembly according to a first embodiment of the present invention.

FIG. 1*a* shows an armoury assembly 100 according to a first embodiment of the present invention. In this preferred embodiment, the armoury assembly 100 comprises at least two layers, wherein a layer 10 completely encircles an energy absorption matrix layer 20. This layer 10 defines the contour of the armoury assembly 100, and is usually made of a metal, an alloy or a fibre reinforced material.

The energy absorption matrix layer 20 has a thickness larger than the outer layer 10. Said energy absorption matrix 20 comprises a solid filler, for instance made of a concrete or the like, such as ashcrete (from fly ash instead of cement) or polymer-concrete or timbercrete. These kind of materials are suitable for absorbing shock waves energy resulting from sudden blast and the matrix is also resistant to high temperature caused by for instance fire. It is also foreseen that the energy absorption matrix 20 can be provided in two, three or more layers. Such multiple layers of energy absorption matrix 20 could increase the blast resistance of various types of direct impacts and shock waves.

Figure 1B:
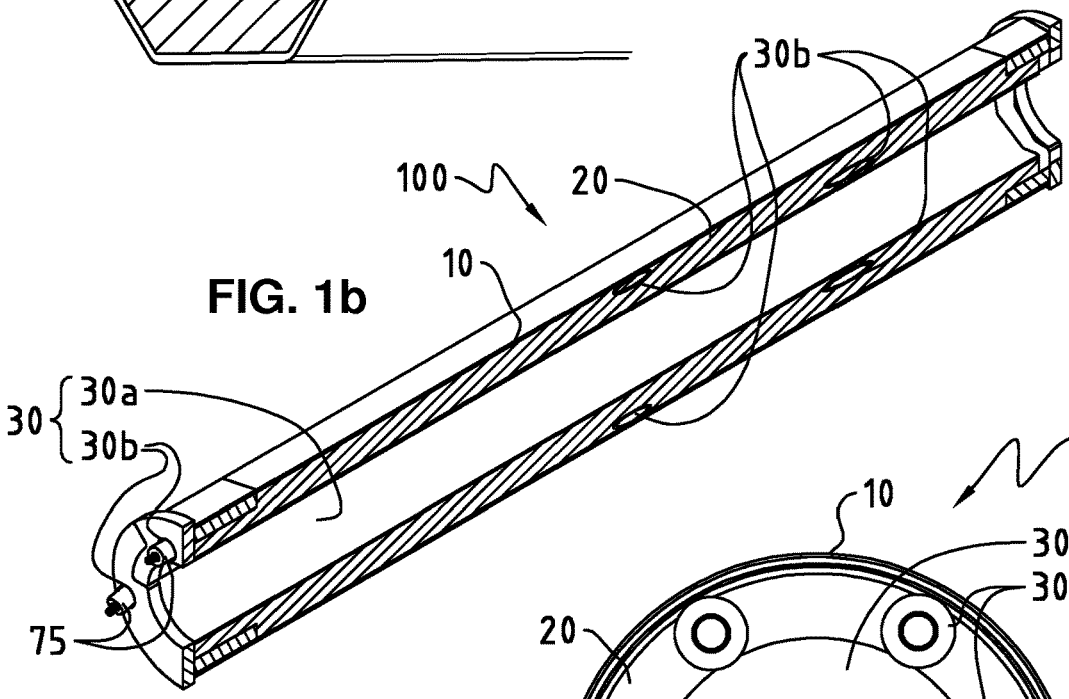
FIG. 1*b* is a longitudinally half-sectioned perspective view of the armoury assembly according to a first embodiment of the present invention.

FIG. 1*b* illustrates a longitudinally half-sectioned perspective view of the armoury assembly 100, which has a predominantly cylindrical shape. To this end, it can be foreseen that any other shape (e.g. square, rectangular, ovul or irregular shapes) can also be protected by the armoury assembly 100 of the present invention, with little or no modification required.

As clearly shown in this FIG. 1*b*, the armoury assembly 100 comprises a layer 10 which is at the outermost of the armoury assembly 100, an energy absorption matrix 20 and a plurality of channels 30, namely a channel 30*a* having a larger diameter in the central longitudinal axis of the armoury assembly 100 and two channels 30*b* having a smaller diameter (on the far left side). The channel 30*a* in the central position is suitable for accommodating elements to be protected. The two channels 30*b* having a smaller diameter compared to the channel 30*a* in the central position are provided to accommodate wire or strand elements 75. These elements 75 can exert a compressing force radially to the armoury assembly 100. These channels 30*b* are provided helically for instance to the energy absorption matrix 20, as can be seen in the half section of the armoury assembly 100 where four partially cut-through channels 30*b* are shown.

In this embodiment, the armoury assembly 100 can be retro-fitted to protect the structural material and/or load-carrying elements which have been completely installed or constructed from external threats. In order to achieve this purpose, the armoury assembly 100 has a "casing-like" structure where the elements to be protected can easily be encased and shielded by the armoury assembly 100 from external threats as described. In other words, the central part of the armoury assembly forms a channel 30 having a large diameter for housing the structural material (e.g. column) and/or load-carrying element (e.g. tensile members of a stay cable). Such configuration allows the elements to be protected do not require any post-constructional modification (or only little structural modifications) for the installation of the armoury assembly 100. Of course, it can also be foreseen that such armoury assembly 100 can also be pre-fitted to the structural material and/or load-carrying element to be protected before the installation or construction.

Figure 1C:
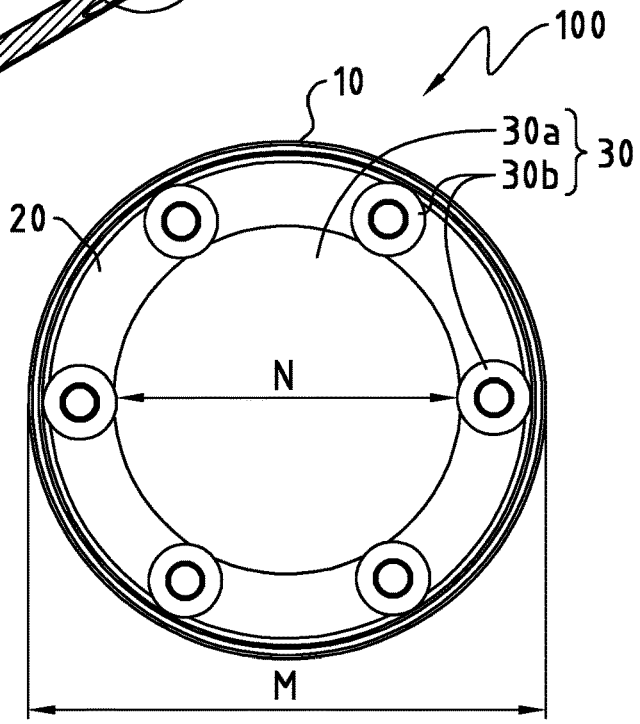
FIG. 1*c* is a plan view of the first embodiment of the present invention.

FIG. 1*c* is a plan view of the first embodiment. This embodiment of the armoury assembly 100 comprises an inner diameter N and an outer diameter M. The inner diameter N of the armoury assembly 100 may range from 50 mm to 400 mm, typically 100 mm to 350, preferably 150 mm to 250 or more preferably around 200 mm. The outer diameter M of the armoury assembly 100 of the present invention may range from about 100 mm to 800 mm, typically from about 200 mm to 500 mm, preferably from about 250 mm to 400 mm or preferably from about 320 mm to 350 mm. In one most preferred embodiment, the inner diameter N and the outer diameter M of the armoury assembly 100 are about 200 mm and 350 mm, respectively. The structural material and/or the load-carrying element (e.g. housed in a pipe) to be protected may have a diameter ranging from about 40 mm to 380 mm, typically from about 100 mm to 280 mm, preferably from about 130 mm to 230 mm or more preferably from about 170 mm to 200 mm.

FIG. 1*c* also illustrates that apart from the channel 30*a* located in the central position of the armoury assembly 100, a plurality of channels 30*b* are additionally provided to the energy absorption matrix 20, wherein the diameter of these channels 30*b* are generally much smaller than the diameter of the channel 30*a* located in the central position. These channels 30*b* typically have a small diameter, for instance ranging from about 5 mm to 80 mm, preferably from about 10 mm to 50 mm, preferably from about 15 mm to 30 mm or in most cases about 25 mm. These channels 30*b* are provided to receive wires or strand elements 75 such that compressing or tensioning force can be exerted radially to the armoury assembly 100. This can be achieved by tightening the wire or strand elements 75 longitudinally around the elements to be protected. Moreover, it is disclosed herewith that these channels 30*b* are distributed in the entire circumferential of the armoury assembly 100, as can be seen in the plan view of the FIG. 1*c*. The distribution of the channels 30*b* can either be random or provided equally spaced from each other.

To this end, it is mentioned that these parameters of the inner diameter N, the outer diameter M of the armoury assembly 100 as well as the diameter of the channel 30*b* for receiving wire or strand elements 75 are applicable to all embodiments of the present invention.

Figure 2A:
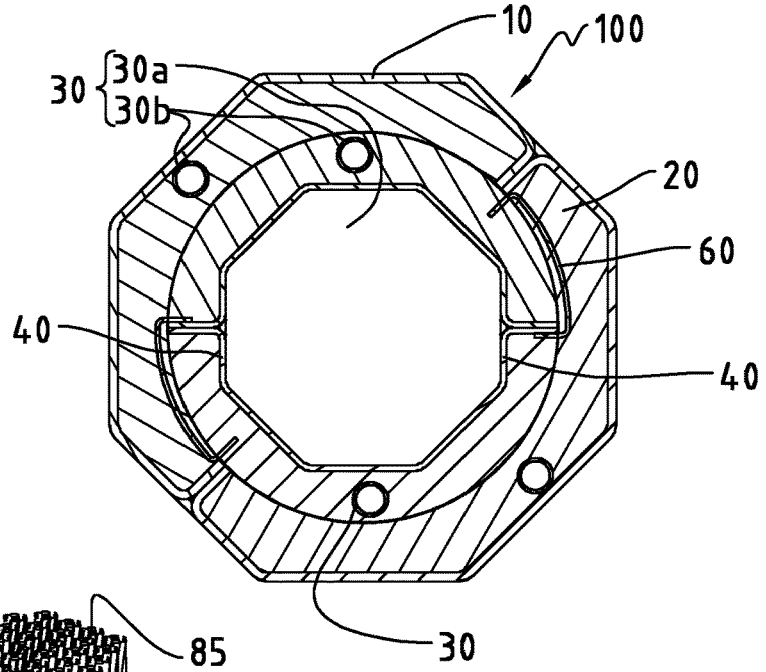
FIG. 2*a* is a cross sectional view of the armoury assembly according to a second embodiment of the present invention.

FIG. 2*a* shows another variant of the embodiment of the present invention, wherein in addition to the outer layer 10 at the outermost surface of the armoury assembly 100, an inner layer 40 can further be provided to the armoury assembly 100, wherein the energy absorption matrix 20 is sandwiched or confined by these two layers, namely the outer layer 10 and the inner layer 40. The channels 30*a*, 30*b* in this second embodiment are otherwise similar as described in the first embodiment.

Figure 2B:
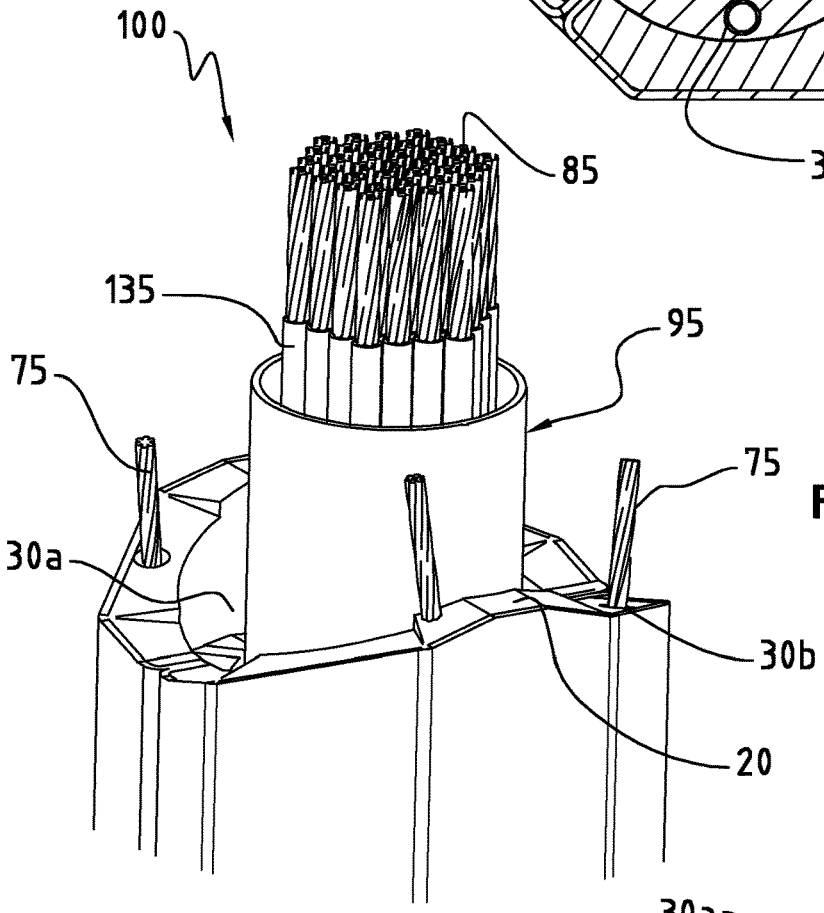
FIG. 2*b* is a perspective view of a second embodiment according to the present invention demonstrating the retrofitted principle of how the armoury assembly is used to protect the load-carrying elements of a stay cable.
Figure 2C:
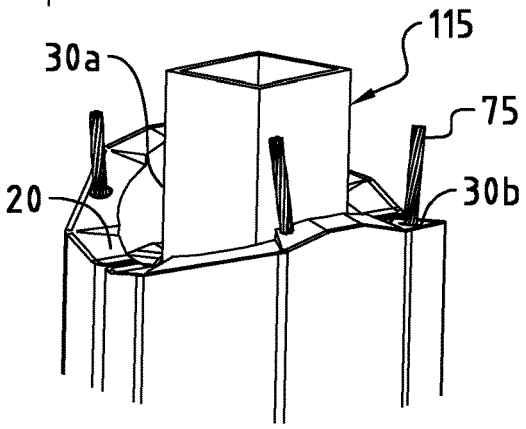
FIG. 2*c* is a perspective view of a second embodiment according to the present invention demonstrating the retrofitted principle of how the armoury assembly is used to protect a structural material.

The channel 30*a* of the armoury assembly 100 according to the first and second embodiments can be used to accommodate load-carrying elements 85, for example of a stay cable 95, as shown in FIG. 2*b*, or can be used to accommodate structural material 115 of a construction or a building such as column, as illustrated in FIG. 2*c*. In both FIGS. 2*b* and 2*c*, the channels 30*b* having a smaller diameter are being provided to the energy absorption matrix 20 accommodate wire and strand elements 75.

To this end, it is mentioned that the load-carrying elements 85 (e.g. tensile members) are typically housed within a pipe of a stay cable 95. Moreover, the armoury assembly 100 of all embodiments of the present invention can be customised such that its inner and outer diameters can be retro-fitted to accommodate different elements to be protected. The armoury assembly 100 of the present invention can be provided for instance in two half sections, and later be connected, tightened and/or sealed to form the armoury assembly 100 as claimed presently. Alternative, the armoury assembly 100 can also be provided in three, four, five or more pieces, assembled, tightened and/or sealed together forming the armoury assembly 100 as described in the first and second embodiments.

The armoury assembly 100 forming from two half, three or more sections allows an easy mounting to the elements to be protected. Nevertheless, such characteristic weakens the capability of the armoury assembly 100 from shielding of different threats such as fire, blasts, mechanical cutting, thermal torch cutting and etc., as gaps or connecting points of the armoury assembly 100 due to the sections are more susceptible to the above-mentioned threats. Therefore, it is foreseeable and preferred that the armoury assembly 100 is provided as one piece e.g. one rounded piece (without connecting sections/pieces/hinges) to minimise the weaker points (e.g. gaps between sections/pieces and hinges) of the armoury assembly 100.

Figure 3A:
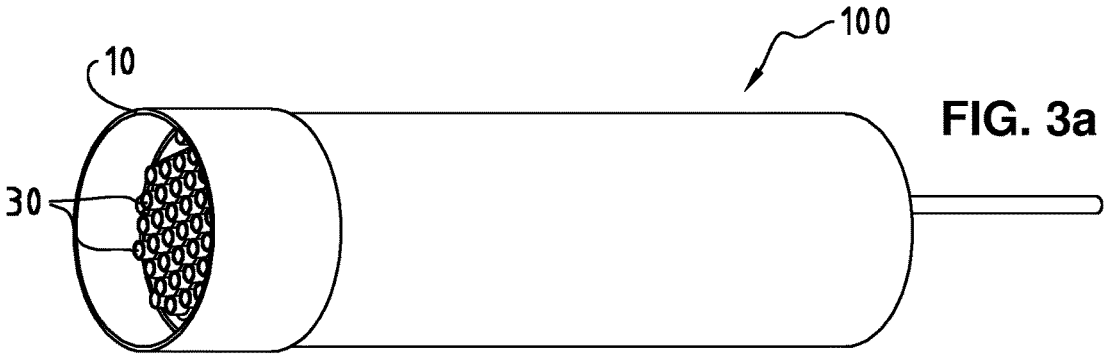
FIG. 3*a* is a perspective view of the armoury assembly according to a third embodiment of the present invention.

Moreover, it is common in the prior art to provide hinges and pin-like elements to connect those two half-pipe together. However, such solution is less optimal compared to the present case where the channel 30*b* having a smaller diameter is provided to receive wire or strand element 75, wherein the wire or strand element 75 is arranged in such a way to exert a compressing force radially along the longitudinal axis of the armoury assembly 100. FIG. 3*a* shows a perspective view of a third embodiment of the armoury assembly 100 according to the present invention, wherein the armoury assembly 100 comprises at least two layers, one being an energy-absorption matrix 20 (not shown), the other 10 is located at the outermost layer of the armoury assembly 100, wherein said layer 10 being made of a metal, an alloy or a fibre reinforced polymer, having a thickness less than the energy-absorption matrix 20. It can be seen in this figure that a plurality of longitudinal channels 30 are being provided to the armoury assembly 100.

Figure 3B:
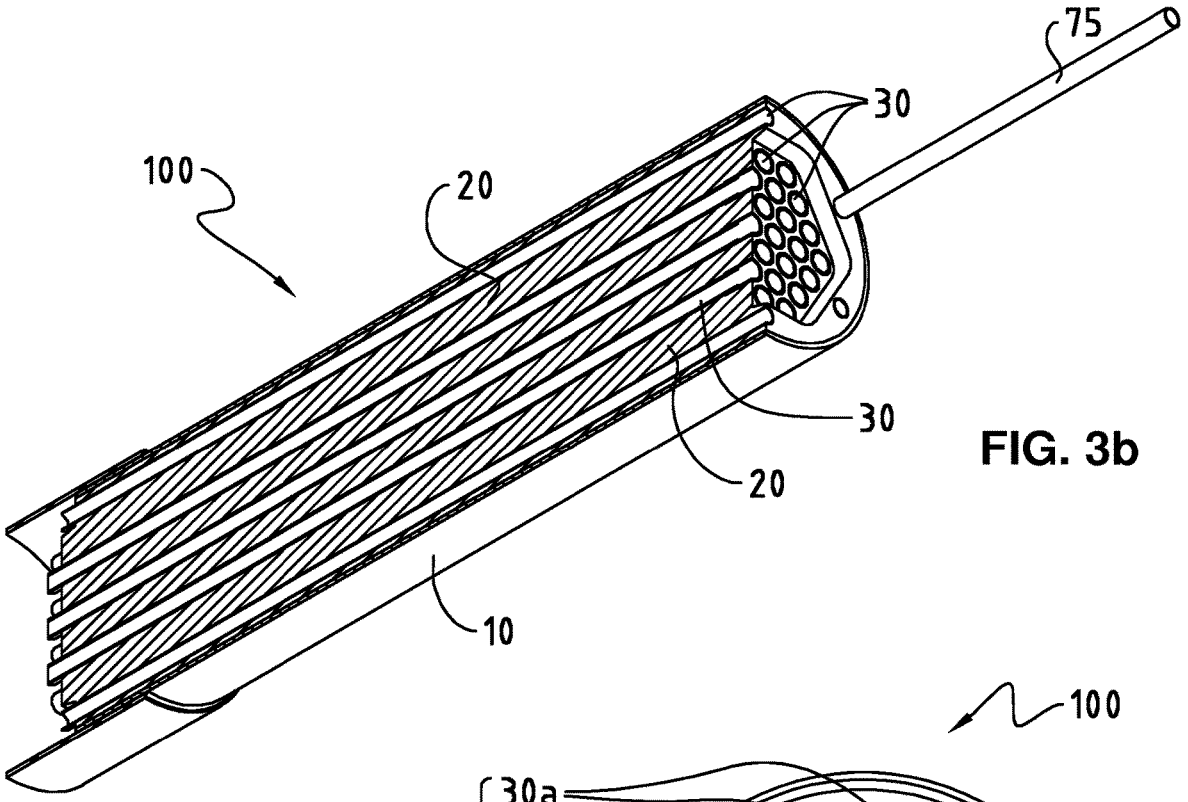
FIG. 3*b* is a longitudinally half-sectioned perspective view of the armoury assembly according to a third embodiment of the present invention.

FIG. 3*b* is a perspective view of the third embodiment where the armoury assembly 100 is longitudinally cut into a half section. As can be seen in the FIG. 3*b*, the channels 30 are substantially parallel to the longitudinal axis of the wire or strand element 75 and/or the elements to be protected (e.g. load-carrying elements).

To this end, it can easily be foreseen that all or most of the channels 30 can be provided to the energy absorption matrix 20 to accommodate the wire or strand element 75, wherein the wire or strand element 75 are arranged in such a way to exert a compressing force radially along the longitudinal axis of the armoury assembly 100. Of course, in other embodiments, only some of the channels can be provided to house the wire and strand element 75 and the rest of the channels can be provided to house the structural material 115 or load-carrying elements 85 including strand sheeting 135.

Figure 3C:
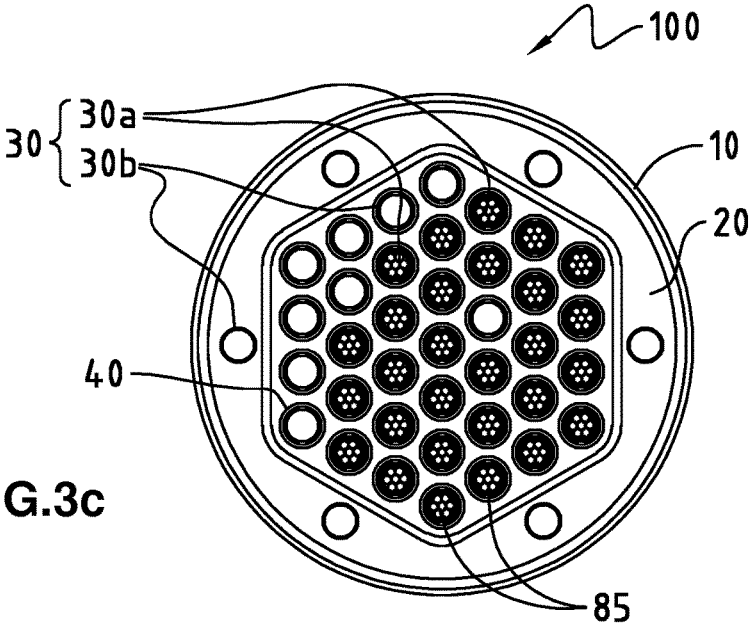
FIG. 3*c* is a plan view of the armoury assembly according to a third embodiment of the present invention.

A plan view of the third embodiment is represented in FIG. 3*c*. A plurality of channels 30 are provided to the armoury assembly 100. Some of the channels 30*a* are provided to accommodate load-carrying elements 85 (shown in this embodiment are 28 channels 30*a* in the central position) while the rest of the channels 30*b* are provided to accommodate wire or strand elements 75 (shown in this example are nine channels 30*b* in the central position and six channels 30*b* in the periphery). Each of these channels 30 can further be encircled by an inner layer 40, wherein the material for such inner layer 40 can be similar to the material for the outer layer 10.

Moreover, it is disclosed herewith that the inner layer 40 described in the FIG. 3*c* can be similar to the inner layer 40 as described in the FIG. 2*a*, wherein the inner layer 40 can be provided to the channels 30*a*, 30*b* for accommodating structural material 115 and/or load-carrying elements 85. The thickness of the inner layer 40 may range from about 0.5 mm to 10 mm, typically from about 1 mm to 5 mm, preferably from about 2 mm to 3 mm or most preferred about 2.5 mm. To this end, it is mentioned that when the inner layer 40 is substantially a circular form, it typically has a diameter ranging from 10 mm to 50 mm, preferably between 20 mm and 30 mm.

Figure 4:
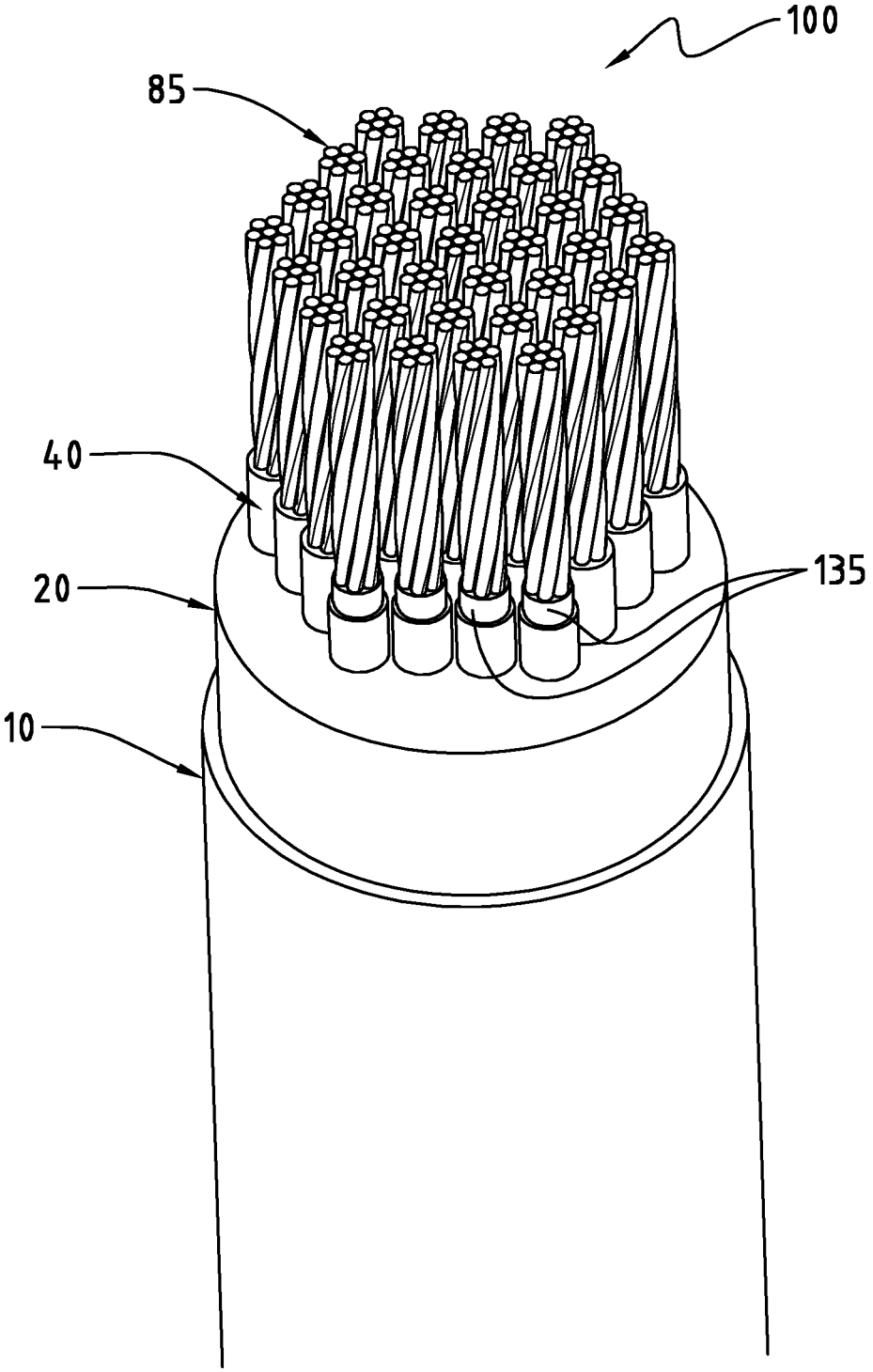
FIG. 4 is a perspective view of a third embodiment according to the present invention demonstrating a pre-fitted principle of how the armoury assembly is used to protect load-carrying elements.

The armoury assembly 100 of this third embodiment can be used to protect the load-carrying elements 85, as illustrated in FIG. 4. The load-carrying elements 85 described herein can for instance be tensile elements. The load-carrying elements may have a surface area of about 150 $mm^2$ and can further be protected by a strand sheathing 135 such as HDPE, before being accommodated into the channels 30. Of course, it can be foreseen that an inner layer 40 in form of a pipe can also be provided to the channel 30, before accommodating the load-carrying elements 85 therein. Although only four load-carrying elements (from the front row in FIG. 4) are shown to be protected by the strand sheathing 135, it can be foreseen that all of them (or only some of them) can be protected by the strand sheathing 135.

To this end, it is disclosed that the armoury assembly 100 of the present invention in all embodiments may further comprise an intermediate connecting component 60 provided to the energy absorption matrix 20. Such intermediate connecting component 60 is illustrated for example in the FIG. 2*a*. The intermediate metal component 60 may be arranged to mechanically connecting an inner layer 40 and an outer layer 10 of the armoury element 100 (or connecting only to the outer layer 10) to increase the mechanical strength of the armour assembly 100.

It is reiterated herewith that in all embodiments, the channels 30, in particular the channel 30*b* having a smaller diameter provided to the energy absorption matrix 20 for accommodating wire and strand elements 75, can be provided either axially or helically around the armoury assembly 100 such that the wire or strand elements 75 accommodated therein can also be extended axially or helically along the armoury assembly 100, such as to be tightened to exert a compressing or tensioning force radially towards the armoury assembly 100.

All variants of the embodiments of the armoury assembly 100 according to the present invention are capable of protecting structural material and/or load-carrying elements from various threats such as fire, TNT cutting charge (e.g. diamond charge, detonating rope and etc.), TNT blast load for instance 0.5 meter away from elements to be protected and/or mechanical or thermal cutting threats.

Specifically, the armoury assembly of the present invention have been tested and have shown it is capable of withstanding fire threat (e.g. rapid rise fire test) according to the UL 1709 standard test (e.g. fire temperature: 1100° C.; duration: 60 min), or as described in the test specifications according to Post-Tensioning Institute (PTI DC45.1-18) on recommendations for stay cable design for instance. The armoury assembly as claimed herewith is also capable of withstanding at least 15 kg and/or at most 100 kg TNT cutting charge; at least 15 kg and/or at most 100 kg TNT blast load at at least 0.5 meter away from the armoury assembly. Moreover, mechanical or thermal cutting tests have been performed and proved to be able to withstand diamond charge, linear cumulative cutting charge and detonating cord assembly (PETN) which are equivalent to approximately 15 kg or even 100 kg TNT. The armoury assembly according to the present invention is also capable of withstanding 100 kg TNT for instance.

Tests have shown that the armoury assembly of the present invention is effective in protecting structural material and/or load-carrying elements. For an armoury assembly to be considered to be fully effective in protecting structural material and/or load-carrying elements from the threats described herein, following values are given:

During the entire fire exposure, the temperature at the vicinity of the elements to be protected shall not exceed 300° C.

As for the cutting charge test, blast test and mechanical and thermal cutting test, after being exposed the threats, the ultimate capacity of the elements to be protected (e.g. load-carrying elements) shall exceed at least 50% of its guaranteed ultimate tensile strength.

By "about" or "approximately" in relation to a given numerical value, it is meant to include numerical values within 10% of the specified value.

The indefinite article "a" or "an" does not exclude a plurality, thus should be treated broadly.

By "one or more" or "at least one" it is meant to include the whole numbers include 1, 2, 3, 4, 5 and more up to a number which can be applied and understood by a skilled person in the art.

The invention claimed is:

1. An armoury assembly for the protection of a structural material and/or load-carrying element having a longitudinal axis, wherein the armoury assembly is provided longitudinally surrounding the structural material and/or load-carrying element to be protected, the armoury assembly comprising a layer of energy-absorption matrix, and an outer layer comprising a metal, an alloy or a fibre reinforced polymer having a thickness less than the layer of energy-absorption matrix, wherein the layer of energy-absorption matrix has opposite, inner and outer surfaces defining a thickness of said layer of energy-absorption matrix therebetween, wherein longitudinal first and second channels are provided to the armoury assembly, wherein the first and second channels are substantially parallel to the longitudinal axis of the structural material and/or the load-carrying element, and wherein the first channel is embedded within the thickness of the layer of energy-absorption matrix.

2. The armoury assembly according to claim 1, wherein at least one of the first and second channels has a geometry which permits threading of a single wire or strand element thereto.

3. The armoury assembly according to claim 1, wherein the energy-absorption matrix comprises a solid filler comprising at least one of concrete, polymer-concrete, ashcrete, timbercrete, the solid filler having a compressive strength of at least about 20 MPa and/or at most about 300 MPa.

4. The armoury assembly according to claim 1, wherein at least one of the first and second channels is/are configured to accommodate one or more wire or strand elements and/or load-carrying elements thereto in such a way to exert compressing forces.

5. The armoury assembly according to claim 1, wherein a pipe element is provided to at least one of said first and second channels for receiving one or more wire or strand elements accommodated thereto, wherein said pipe element is configured such that the one or more wire or strand elements extend axially or helically along the longitudinal axis.

6. The armoury assembly according to claim 1, wherein the outer layer comprises a plurality of patch-like elements assembled, connected and tightened to each other, such as to permit later retrofit of a critical member.

7. The armoury assembly according to claim 1, further comprising an inner layer made of a metal, an alloy, or fibre reinforced polymer.

8. The armoury assembly according to claim 5, further comprising an inner layer made of metal, an alloy, or fibre reinforced polymer, wherein the pipe element is the inner layer.

9. The armoury assembly according to claim 7, wherein the inner layer surrounds longitudinally the load-carrying element and has a same thickness as the outer layer.

10. The armoury assembly according to claim 1, further comprising an inner layer made of metal, an alloy, or a fibre reinforced polymer, wherein the layer of energy absorption matrix is sandwiched between the outer layer and the inner layer.

11. The armoury assembly according to claim 1, further comprising a plurality of the first channels all having approximately a same diameter, wherein the plurality of the first channels are provided to the armoury assembly for accommodating wire or strand elements and/or additional load-carrying elements.

12. The armoury assembly according to claim 11, wherein the plurality of the first channels are arranged approximately equidistant from each other.

13. The armoury assembly according to claim 1, further comprising an inner layer, the outer layer being made of a material having a yield strength of at most about 2000 MPa and/or at least about 200 MPa, and the inner layer is made of a material having a yield strength of at most 2000 MPa and/or at least about 200 MPa.

14. The armoury assembly according to claim 1, wherein the second channel is centrally located and defined by the inner surface of the layer of energy-absorption matrix.

15. The armoury assembly according to claim 14, further comprising a plurality of the first channels that are spaced circumferentially about the second channel.

16. The armoury assembly according to claim 14, wherein a pipe is provided in the second channel.

17. A stay cable pre-fitted or retro-fitted with the armoury assembly according to claim 1.

18. A structural material of a construction or a building, comprising a structural component selected from among a column, a rod, a beam pre-fitted or retro-fitted with the armoury assembly according to claim 1.

* * * * *